US005221273A

United States Patent [19]

Graham

[11] Patent Number: 5,221,273

[45] Date of Patent: Jun. 22, 1993

[54] UNDERPAD

[75] Inventor: James E. Graham, Marietta, Ga.

[73] Assignee: Medical Disposables Company, Marietta, Ga.

[21] Appl. No.: 676,280

[22] Filed: Mar. 28, 1991

[51] Int. Cl.[5] ..... A61F 13/15; A61F 13/20; A47C 31/00

[52] U.S. Cl. ..... 604/358; 604/385.1; 5/500

[58] Field of Search ..... 604/358, 385.1; 5/500, 5/499, 498, 411, 508, 496, 495, 502

[56] References Cited

U.S. PATENT DOCUMENTS

| | | | |
|---|---|---|---|
| 1,722,429 | 7/1929 | Kaufmann . | |
| 1,892,841 | 1/1933 | Kaufmann . | |
| 2,024,050 | 12/1935 | May . | |
| 2,099,427 | 11/1937 | Karr . | |
| 2,930,053 | 3/1960 | Nowels . | |
| 2,931,084 | 4/1960 | De Witt . | |
| 3,092,848 | 6/1963 | Gronvold . | |
| 3,407,414 | 10/1968 | Burns et al. | 5/500 X |
| 3,427,670 | 2/1969 | Nimoy | 5/500 X |
| 3,528,421 | 9/1970 | Vaillancourt et al. | 5/500 X |
| 3,576,039 | 4/1971 | Roberts | 5/500 X |
| 3,666,611 | 5/1972 | Joa | 604/358 X |
| 3,670,345 | 6/1972 | Doll et al. | 5/500 X |
| 3,765,040 | 10/1973 | Holstein | 5/496 X |
| 3,868,287 | 2/1975 | Lewyckyj | 604/358 |
| 3,871,037 | 3/1975 | Willington | 5/500 |
| 4,199,830 | 4/1980 | Ogata | 5/411 |
| 4,199,831 | 4/1980 | Müller | 5/498 X |
| 4,241,466 | 12/1980 | Mendyk | 5/500 X |
| 4,519,798 | 5/1985 | Dinius | 604/358 |
| 4,536,028 | 8/1985 | Jones et al. | 5/496 X |
| 4,536,433 | 8/1985 | Sagi et al. | 604/358 X |
| 4,552,795 | 11/1985 | Hansen et al. | 604/358 X |
| 4,627,426 | 12/1986 | Wegener et al. | 604/358 X |
| 4,662,013 | 5/1987 | Harrison | 5/498 X |
| 4,662,016 | 5/1987 | Seeman | 5/508 |
| 4,664,959 | 5/1987 | Dagenais et al. | 5/500 X |
| 4,712,261 | 12/1987 | Castro | 5/501 X |
| 4,728,326 | 3/1988 | Gilles | 604/391 |
| 4,768,252 | 9/1988 | Ross | 5/498 X |
| 4,769,021 | 9/1988 | Kass | 604/358 X |
| 4,772,281 | 9/1988 | Armstead | 604/358 |
| 4,813,944 | 3/1989 | Haney et al. | 604/358 |
| 4,822,435 | 4/1989 | Igaue et al. | 604/358 X |
| 4,846,823 | 7/1989 | Enloe | 604/358 X |
| 4,862,541 | 9/1989 | Hutton et al. | 5/496 |
| 4,891,856 | 1/1990 | Thornhill | 5/496 |
| 4,961,238 | 10/1990 | Limb et al. | 5/500 |

*Primary Examiner*—Randall L. Green
*Assistant Examiner*—Elizabeth M. Burke
*Attorney, Agent, or Firm*—Kennedy & Kennedy

[57] ABSTRACT

An underpad for use in absorbing waste products of an incontinent person reclining on a bed mattress comprises a liquid resistent backing having a central portion straddled by two opposite end seams. Liquid absorbent batting is mounted to the backing central portion. The underpad also has a pair of elastic straps of lengths sufficient to be fastened to opposite backing end seams and drawn tautly in generally mutually parallel relation with each other beneath the mattress with the backing placed atop the mattress. Fastening means are also included for fastening the ends of the straps to the backing opposite side portions.

9 Claims, 2 Drawing Sheets

Fig 1
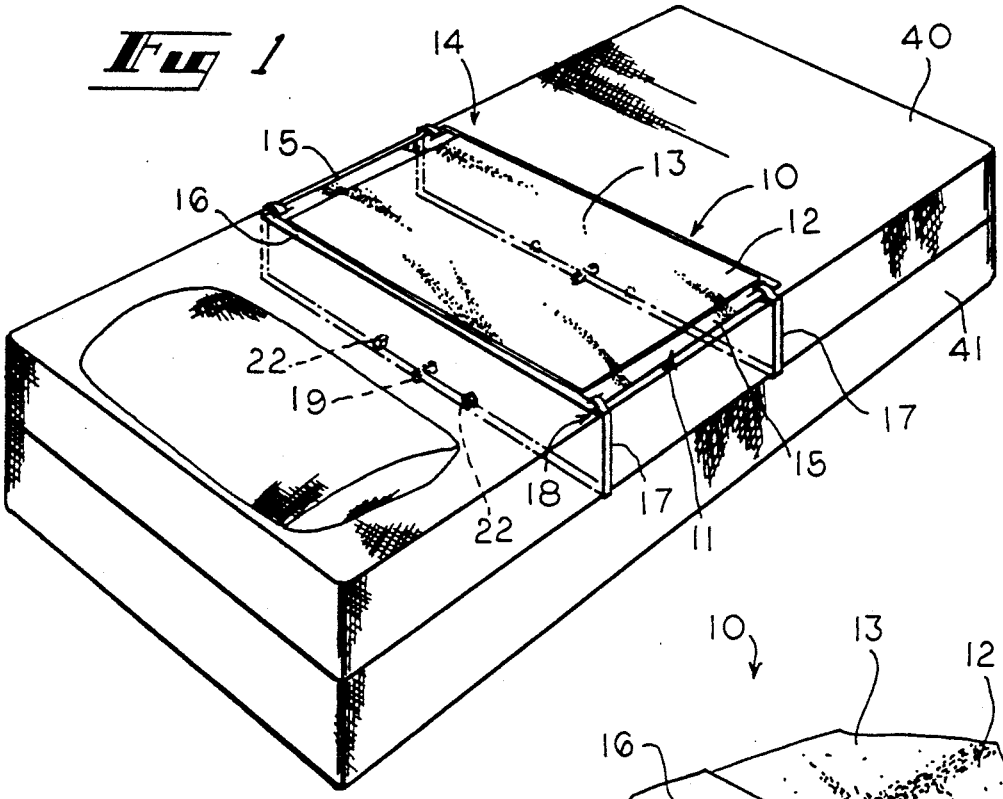
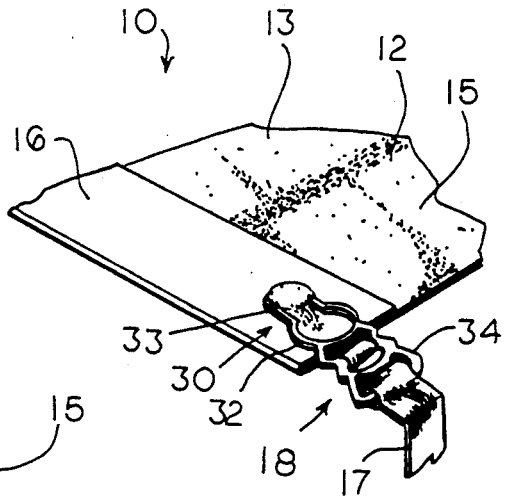
Fig 3
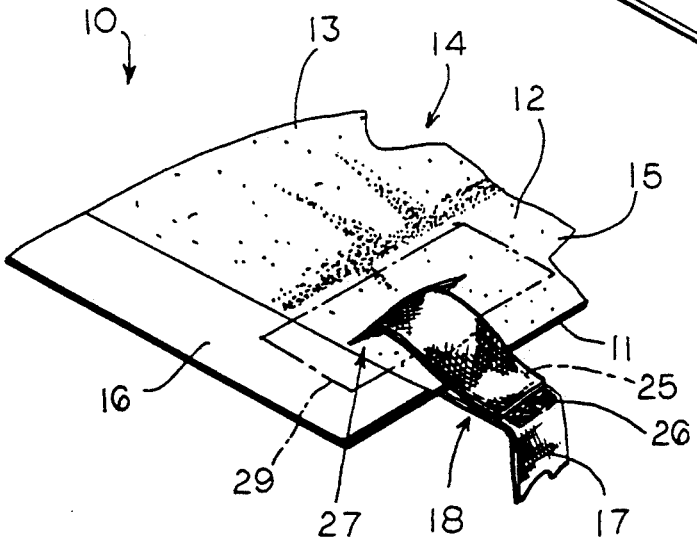
Fig 2

UNDERPAD

TECHNICAL FIELD

This invention relates to underpads for use in absorbing waste products of bedridden incontinent persons.

BACKGROUND OF THE INVENTION

Underpads or linen protectors are commonly used to cover an area of bed linen beneath the pelvic region of bedridden incontinent persons and hospital patients. These underpads typically have a liquid absorbent batting which absorbs human waste liquids, namely urine, and a liquid resistent backing to prevent absorbed liquids from soiling the linen or mattress. A problem long associated with these underpads is that they tend to move and slide out of proper position, thereby exposing the underlying bed linen as the persons lying on them move about. Another problem long associated with their use is that they tend to wrinkle and bunch up beneath the patients causing patient discomfort and contributing to the development of decubitus pressure lesions, commonly referred to as bed sores. Because of these problems several approaches have been taken to design and develop underpads that remain securely in place in a wrinkle free manner.

One such approach has been to extend the liquid resistent backing area coverage so that it drapes over the sides of the mattress and can be tucked between the mattress and the underlying box springs and thereby held tautly in place. In a disposable version of this type of underpad the batting is glued to the backing. This however is not cost efficient since the backing is made much larger than necessary to prevent linen soiling all of which is discarded after use. In a reusable version a frame made of flexible plastic is mounted to the backing to which the batting is removably mounted. The frame must be mounted so as not to contact and thereby cause patient discomfort. To this end the frame is mounted along the portion of the backing that is closely adjacent to the mattress side edges with the batting secured along its two opposite side edges. A problem with this approach is that since the mid-portion of the batting is not secured to the backing the batting may still become wrinkled. Also, patent movements tend to cause the batting to become dismounted from the frame. Another problem associated with both the disposable and reusable versions is that it is fairly easy for the tucked portion of the backing to work loose and thereby fail to provide the support necessary for maintaining the underpad tautly in position.

Another approach taken has been to mount strips of adhesive on the bottom of the underpad backing sheet in contact with the bed linen in order to secure the underpad directly to the linen. However, after use residual adhesive tends to remain on the linen, even when washed, thus creating a messy, unsanitary and unsightly condition.

It thus is seen that a need remains for an underpad that remains well in place and which resists wrinkling while positioned beneath a person as that person moves about while reclined upon the underpad. Accordingly, it is to the provision of such an underpad that the present invention is primarily directed.

SUMMARY OF THE INVENTION

In a preferred form of the invention, an underpad for use in absorbing waste products of an incontinent person reclining on a bed mattress comprises a liquid resistent backing having a central portion straddled by two opposite end seams. Liquid absorbent batting is mounted to the backing central portion. The underpad also has a pair of straps, at least a portion of each of which is elastic. The straps are of lengths sufficient to be fastened to opposite backing end seams and drawn tautly in generally mutually parallel relation with each other beneath the mattress with the backing placed atop the mattress. Fastening means are also included for fastening the ends of the straps to the backing opposite end seams. The underpad may also include keepers for preventing the ends of the straps and fasteners from being pulled under the mattress during mounting.

BRIEF DESCRIPTION OF THE DRAWING

FIG. 1 is a perspective view of an underpad embodying principles of the present invention shown mounted to a mattress.

FIG. 2 is a perspective view of a corner portion of the underpad of FIG. 1.

FIG. 3 is a perspective view of a corner portion of the underpad of FIG. 1 with fastening means of alternative construction.

DETAILED DESCRIPTION

Figure 6:
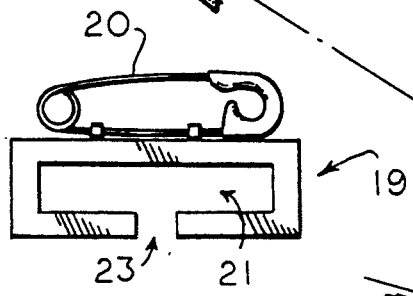
FIG. 6 is an enlarged side elevational view of a keeper component of the underpad.

With reference next in more detail to the drawings, there is shown an underpad 10 comprising a plastic liquid impervious backing or sheet 11, and a liquid pervious cover 12 that overlays the backing. A liquid absorbing batting 13 is mounted between a central portion 14 of the backing and cover. Two opposing end borders or end seams 15 of the cover and backing, that straddle the central portion 14, are mounted flushly together so that the batting 13 cannot extend into these seams or into two side portions or side seams 16. The underpad also has a pair of elastic straps 17 each having a length in a relaxed condition of less than the sum of the mattress width and twice its height and greater than the mattress selected width. The elastic straps have fastening means 18 mounted to each of their ends. Though the straps are preferably elastic throughout, they may instead have elastic and inelastic components. The underpad here also has a pair of keepers 19 each of which, as best shown in FIG. 6, has a channel 21 through which a strap 17 may loosely extend and into which a strap may be laterally inserted and extracted through an access slot 23. Each keeper also has a safety pin 20 mounted to the side of the channel opposite the access slot and a pair of elongated stops 22 mounted to each strap 17 so as to straddle the channel 21.

As best shown in FIG. 2, in one embodiment each of the fastening means for the straps comprises a first strip of fibrous material 25 affixed to one end of the strap 17, and a second strip of fibrous material 26 affixed to the strap adjacent the first strip 25 for releasible attachment to the first strip 25. Mating fibrous strips known as Velcro are preferably used here.

Each end seam 15 of the backing is formed with a pair of slits 27 through which the strap ends having the first strip of fibrous material 25 are extended, double backed and meshed with the adjacent second strips 26 thereby releasably securing the strap end to the backing. Slit reinforcement strips 29 are also mounted as by gluing to the backing end seam to prevent the strap 17 from being ripped through the backing as tension is applied. The reinforcement strips also have unshown slits that are aligned with the slits 27. Here it should be noted that the backing end seam slits 27 are located away from the batting 13. This serves to prevent liquids absorbed into the batting from migrating onto the fastened straps 17 and soiling them too.

Figure 4:
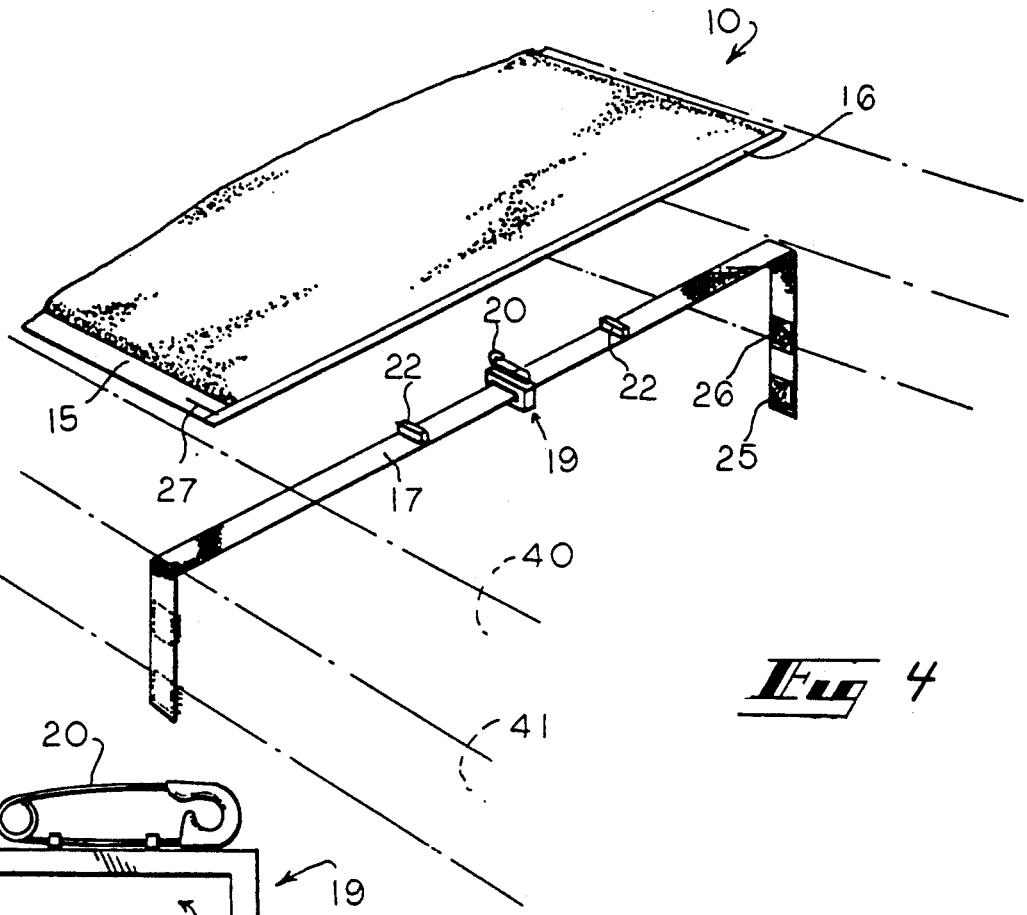
FIG. 4 and 5 are perspective views of a portion of the underpad of FIG. 1 shown in successive stages of being mounted to a mattress.

To mount the underpad, each keeper 19 is mounted to the underside of the mattress 40 of a bed by lifting and pinning its safety pin 20 centrally to the mattress. The straps 17 are then slid through the channel access slots 23 into the keeper channels 21 with the stops 22 straddling the keeper. The straps are then laid transversely in mutually parallel relation across the underlying box springs 41 of the bed with the strap ends overhanging the box springs, as shown in FIG. 4. The backing sheet is then placed flat atop the mattress 40 with its end seam 15 located closely adjacent to and along side the mattress sides, as also shown in FIG. 4.

Figure 5:
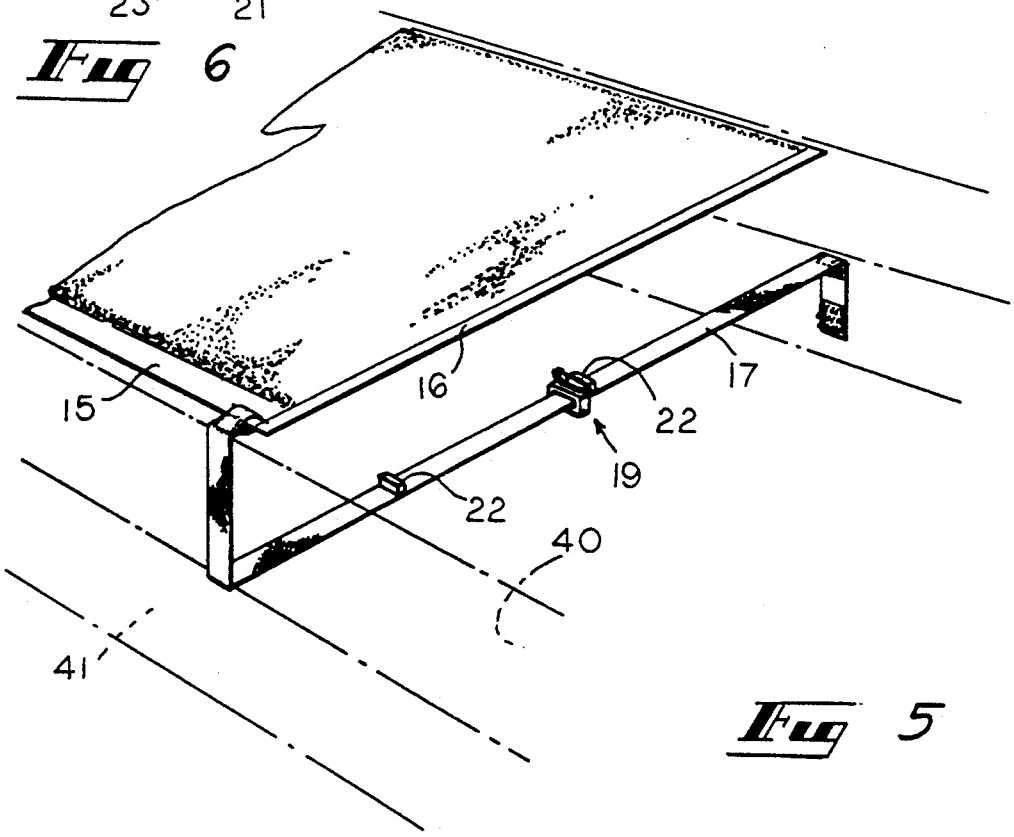

Each strap end is then fastened to a backing end seam 15 by pulling and stretching the strap sufficiently to pass the strap end portion bearing the first strip 25 of fibrous material through a slit 27 and then into mesh with the second strip 26 of fibrous material 26. Note that if the strap end is accidentally released in doing this with the elastic strap tensed, the end will not be elastically drawn underneath the mattress since an adjacent stop 22 will contact the keeper 19 and thereby limit such snap-back action of the strap. This is because each stop is mounted to the strap at a distance from the center of the strap and keeper that is less than the distance of the strap end to the point of strap end entry between mattress and bed springs in its relaxed state. This prevents the strap ends and fasteners from being pulled between the mattress and the box springs whereby the bed attendant would have more difficulty in locating, reaching and extracting the strap end. Furthermore, in attaching one end of the elastic strap, its opposite end is also prevented from being pulled beneath the mattress by the other strap. This situation is shown in FIG. 5.

Once one end of each strap 17 is fastened to an end seam 15 of the backing the opposite end of the strap is then fastened to the other end seam in the same manner so that the two straps are substantially parallel. The other strap is also mounted to the other two corners in the same manner. The underpad, now mounted to the bed, as shown in FIG. 1, will usually remain snugly and tautly in place even after a person has reclined on it for substantial periods of time and made numerous body movements including whole body positions shifts from side to side.

Once the underpad becomes soiled, its backing sheet and batting may be removed and discarded by simply unfastening the strap fastening means and leaving the strap ends dangling as shown in FIG. 4. Should the straps themselves also become soiled they may also be removed and washed by passing the strap back through the channel access slot 23 without removing the keeper plate. A fresh backing with cover and batting may then be mounted as previously explained.

In FIG. 3, strap fastening means of an alternative construction are shown to have a metallic retaining ring 30 mounted to one end of the strap 17 and an unshown, resilient button 31 hingedly attached to the ring. The ring has a relatively large button receiving portion 32 that merges with a smaller button retention portion 33. It also has a loop 34 to which a strap end is permanently mounted as by stitching. For mounting, the button 31 is located below the backing sheet and pushed through the retaining ring receiving portion 32 thereby forcing a portion of the side seam 16 also through the receiving portion 32. The button is then slid into the retention portion 33 thereby firmly capturing the sheet border. Since the loop 34 and strap are spaced from the mounting ring, again the strap is spaced from the batting such that liquid waste is not drawn to it from the batting.

It thus is seen that an underpad is now provided that overcomes problems long associated with those of the prior art. It should be understood that the just described embodiments merely illustrate principles of the invention is preferred forms. Many modifications, additions and deletions may, in addition to those expressly recited, be made without departure from the spirit and scope of the invention as set forth in the following claims.

I claim:

1. An underpad for absorbing waste products of an incontinent person reclining on a bed mattress of a selected width and height, with the underpad comprising a liquid resistent backing having a central portion straddled by two opposite end portions, liquid absorbent batting mounted to said central portion or said backing, a pair of straps at least a portion of each of which is elastic and with said straps being of a length sufficient to be fastened to said opposite end portions of said backing and drawn tautly in substantially mutually parallel relation beneath the mattress, with said backing placed atop the mattress, each of said straps having a length in a relaxed condition greater than said selected width of said mattress and less than a sum of said selected width and twice said selected height of said mattress and fastening means for fastening each of said straps to said opposite end portions.

2. The underpad of claim 1 further comprising keeper means for limiting movement of at least one of said straps sufficient to prevent said fastening means from being drawn beneath the mattress upon being released from said backing.

3. The underpad of claim 2 wherein said keeper means has a guide channel through which said strap extends and pin means for releasably pinning said guide channel to a bottom of the mattress.

4. The underpad of claim 2 wherein said keeper means further comprises a pair of stops mounted to said strap and straddling said guide channel.

5. The underpad of claim 1 wherein each of said fastening means is comprised of a first fibrous strip of material mounted to an end portion of said strap and a second fibrous strip of material configured to mesh with said first fibrous strip mounted to said strap adjacent said first fibrous strip, and wherein said liquid resistent backing has slots through which said first fibrous strip may be extended and coupled with said second fibrous strip.

6. The underpad of claim 1 wherein each of said fastening means comprises a retaining ring mounted to one end of said strap and a button sized to be releasably retained within said retaining ring with said backing captured and held between said button and said retaining ring.

7. The underpad of claim 1 wherein said straps are fastened to said end portions of said backing spaced from said batting so that liquid absorbed by said batting may not be directly contacted by and thereby absorbed by said straps.

8. The underpad of claim 1 further comprising a liquid pervious cover that overlaps said liquid absorbent batting and is seamed to said backing along said backing end portions.

9. An underpad for use atop a mattress of a selected width and height and with the underpad having a generally rectangular liquid resistant sheet with four corner regions upon a central portion on which water absorbent material is mounted; a pair of at least partially elastic straps having opposite ends configured to be releasably mounted in substantially parallel relation with each other to said water resistant sheet four corner regions, said elastic straps having a length in a relaxed condition of less than a sum of the selected width of said mattress and twice selected height of said mattress and greater than the selected width; keeper means for limiting movement of said straps sufficient to prevent said strap ends from being drawn beneath the mattress upon being released from said liquid resistant sheet with said sheet mounted atop the mattress; and fastening means for releasably mounting said strap ends to said liquid resistant sheet four corners.

* * * * *